US007339131B2

(12) United States Patent
Yamamoto et al.

(10) Patent No.: US 7,339,131 B2
(45) Date of Patent: Mar. 4, 2008

(54) SLIDE SWITCH APPARATUS

(75) Inventors: Shusaku Yamamoto, Osaka (JP); Takahiro Honbu, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/464,258

(22) Filed: Aug. 14, 2006

(65) Prior Publication Data

US 2007/0074966 A1 Apr. 5, 2007

(30) Foreign Application Priority Data

Aug. 25, 2005 (JP) ..... 2005-243848

(51) Int. Cl.
*H01H 15/10* (2006.01)

(52) U.S. Cl. ..... 200/547; 200/548; 200/574

(58) Field of Classification Search .... 200/16 R–16 D, 200/547–551, 533, 574, 296, 329
See application file for complete search history.

(56) References Cited

U.S. PATENT DOCUMENTS 3,963,884 A * 6/1976 Pollock ..... 200/16 D
4,029,914 A * 6/1977 Schmidt et al. ..... 200/1 R
4,833,280 A * 5/1989 Bingo et al. ..... 200/16 D
5,967,302 A * 10/1999 Lin ..... 200/550
6,204,461 B1 * 3/2001 Bucher et al. ..... 200/330
6,333,479 B1 * 12/2001 Tai ..... 200/550
6,380,502 B1 * 4/2002 Hirschburger et al. ..... 200/548
6,759,608 B2 * 7/2004 Chu ..... 200/16 D
6,930,264 B2 * 8/2005 Nagai et al. ..... 200/252
7,208,692 B2 * 4/2007 Yamaguchi ..... 200/547

FOREIGN PATENT DOCUMENTS

JP 3-236006 10/1991

* cited by examiner

*Primary Examiner*—Michael A Friedhofer
(74) *Attorney, Agent, or Firm*—Hamre, Schumann, Mueller & Larson, P.C.

(57) ABSTRACT

In a slide switch apparatus of the present invention, a click spring movable along a side surface portion of a housing includes an engagement portion that is engaged with a switch lever and can be switched in accordance with the movement along the side surface portion of the housing, a protrusion that generates a click feeling when moving along the side surface portion of the housing, a positioning rib, and a plate spring portion in which the engagement portion, the protrusion, and the positioning rib are placed and which can be deformed elastically. The positioning rib is placed between the engagement portion and the protrusion in the movement direction of the click spring. Because of this, a slide switch apparatus whose housing can be miniaturized is obtained.

17 Claims, 16 Drawing Sheets

SLIDE SWITCH APPARATUS

BACKGROUND OF THE INVENTION

1. Field of the Invention

The present invention relates to a slide switch apparatus capable of performing a slide operation in a predetermined direction. In particular, the present invention relates to a slide switch apparatus useful for being mounted on a lens unit of a photographing appliance such as a video camera or a digital still camera.

2. Description of Related Art

Regarding a recent photographing apparatus such as a video camera or a digital still camera, the functionality and performance have increased, and a model with a lens portion having a wide-ranging function is becoming mainstream. Furthermore, although the operation of the photographing apparatus is performed in most cases with a switch placed on a camera body side, the operation related to a lens function may be performed with a switch placed in a lens barrel portion. As such a switch placed in the lens barrel portion, for example, a slide switch mainly is used in most cases, as disclosed in JP 3(1991)-236006 A.

FIG. 16 is a perspective view showing an outer appearance of a conventional photographing apparatus. FIG. 17 is a cross-sectional view taken along a line Z-Z in FIG. 16

As shown in FIG. 16, a camera body 300 includes a substantially cylindrical lens unit 301 on a front case 302. In the lens unit 301, a lens group including a focus lens, a zoom lens, and the like is placed. A lens ring 303 placed on a cylindrical surface of the lens unit 301 is provided with a slide knob 304 that is slidable in an arrow P or Q direction.

As shown in FIG. 17, a slide switch 305 is placed below the slide knob 304, and a protrusion 306 of the slide switch 305 is fitted in a lower end of the slide knob 304. The slide switch 305 is fixed to a lens frame 308.

In the above configuration, when the slide knob 304 is slid in the arrow P or Q direction, the protrusion 306 slides in the arrow P or Q direction in synchronization with the movement of the slide knob 304, whereby a switching operation can be performed.

However, the configuration disclosed in JP 3(1991)-236006 A has the following problem: since the slide switch 305 is placed below the slide knob 304, the lens unit 301 (cylinder) cannot be miniaturized. More specifically, as shown in FIG. 17, the outer diameter of the lens unit 301 is required to have at least a thickness R of the slide knob 304 and the slide switch 305, so that the lens unit 301 cannot be miniaturized further.

SUMMARY OF THE INVENTION

Therefore, with the foregoing in mind, it is an object of the present invention to provide a slide switch apparatus whose housing can be miniaturized.

In order to achieve the above object, a slide switch apparatus of the present invention includes: a slide member movable along a side surface portion of a housing; and a switch that is placed on the side surface portion of the housing and is capable of switching an operation state when a portion to be acted on is driven. The slide member includes: a switch engagement portion capable of driving the portion to be acted on in accordance with a movement of the slide member along the side surface portion of the housing; a click portion that comes into contact with the housing or another member, thereby generating a click feeling when moving along the side surface portion of the housing; and a portion to be held for allowing the housing to movably hold the slide member. The portion to be held is placed between the switch engagement portion and the click portion in a movement direction of the slide member.

DETAILED DESCRIPTION OF THE INVENTION

Figure 1:
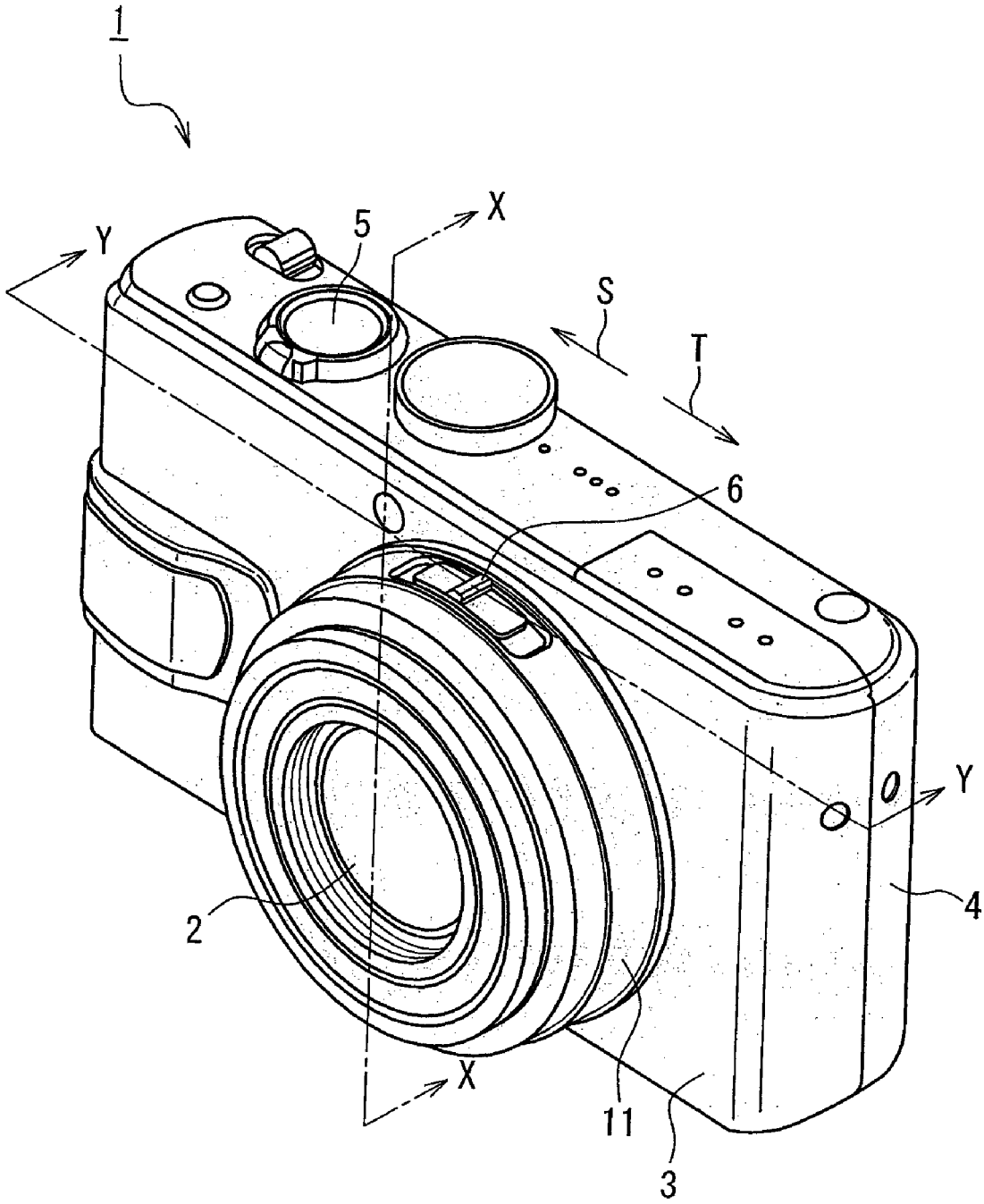
FIG. 1 is a perspective view showing an outer appearance of a photographing apparatus with a slide switch apparatus in Embodiment 1 mounted thereon.

In the slide switch apparatus of the present invention, the switch can be placed at a position overlapping the switch engagement portion in a thickness direction. According to this configuration, the thickness of the vicinity of the switch can be decreased, which can miniaturize the apparatus.

Furthermore, the slide member can include a concave portion at a site opposed to the switch, and a part or entirety of the switch is placed in the concave portion. According to this configuration, the dimension in the width direction of the vicinity of the switch can be decreased, which can miniaturized the apparatus.

Furthermore, the portion to be acted on can be a switch lever, a concave portion in a substantially Ω shape can be formed in the switch engagement portion, and the switch lever can be engaged with the concave portion. According to this configuration, the switch lever is unlikely to come out of the concave portion, and the inner wall of the concave portion does not hinder the rotation operation of the switch lever, so that the switching operation of the switch can be performed exactly.

Furthermore, the switch engagement portion can be set to be thicker than the switch lever. According to this configuration, the switch lever is unlikely to come out of the switch engagement portion, so that the switching operation of the switch can be performed exactly.

Furthermore, the switch engagement portion can be made of resin. According to this configuration the friction of the portion to be acted on can be reduced. Furthermore, the reduction in friction can suppress dust generated when the switch engagement portion is scraped.

Furthermore, the slide switch apparatus of the present invention further can include a slide knob that is placed on a surface of the housing and fixed to the slide member, wherein, on the surface of the housing, a concave portion is formed at a site where the slide knob is placed. According to this configuration, during assembly of the slide switch apparatus, the slide knob can be positioned, which can enhance the assembling operation.

Furthermore, the slide switch apparatus of the present invention further can include a slide knob that is placed on a surface of the housing and fixed to the portion to be held of the slide member, wherein, in the slide knob, a rib is formed at a site where the slide knob is fixed to the portion to be held, and in the portion to be held, a concave portion capable of being engaged with the rib is formed. According to this configuration, when the slide knob is engaged with the portion to be held, both of them can be positioned, which can enhance the assembling operation.

Furthermore, the slide switch apparatus of the present invention further can include a slide knob that is placed on a surface of the housing and fixed to the portion to be held of the slide member with a screw, wherein the screw is placed so as to tilt with respect to a vertical line of a principal plane of the slide member. According to this configuration, when the screw is screwed in with a driver or the like, the tip end of the driver can be engaged with the head of the screw exactly, which can enhance the assembling operation.

Furthermore, the slide switch apparatus of the present invention further can include a substrate capable of being deformed elastically, on which the switch engagement portion, the click portion, and the portion to be held are placed, wherein a hole is formed between the click portion and the portion to be held on the substrate. According to this configuration, the click feeling can be decreased by enlarging the hole, and the click feeling can be strengthened by reducing the size of the hole. Therefore, an arbitrary click feeling can be realized by optimizing the size of the hole.

Furthermore, the switch can be composed of a self-reset type switching element. According to this configuration, the looseness between the switch lever and the slide member can be reduced. Furthermore, since the switch lever is always at a neutral position in the self-reset type switching element, the assembling operation can be enhanced by assembling each component based on the position of the switch lever.

Furthermore, the slide switch apparatus of the present invention further can include a substrate, wherein the click portion, the portion to be held, and the switch engagement portion are formed on the substrate by molding resin at one time. According to this configuration, the above members can be molded at one time by insert molding, so that the assembling operation can be enhanced.

Furthermore, the slide switch apparatus of the present invention further can include a substrate, wherein the switch engagement portion, the click portion, and the portion to be held are formed on the substrate after the substrate is bent. According to this configuration, the assembling operation can be enhanced.

Furthermore, the housing can be composed of a first housing in which at least the slide member and the switch are placed, and a second housing that covers a surface of the first housing, wherein the switch is connected to a flexible substrate capable of being connected electrically to another circuit, and the fixable substrate is placed between the first housing and the second housing. According to this configuration, the flexible substrate can be protected from damages.

Furthermore, the slide switch apparatus of the present invention can include a plurality of switches, wherein the plurality of switches are connected to one flexible substrate capable of being connected electrically to another circuit. According to this configuration, the flexible substrate can be decreased, which can miniaturize the apparatus.

Furthermore, the slide switch apparatus of the present invention can include a first switch and a second switch as the plurality of switches, and a first slide member and a second slide member for driving the respective switches, wherein the first slide member and the second slide member are attached to the housing so that respective switch engagement portions are placed at a site where the first slide member and the second slide member are opposed to each other. According to this configuration, the distance between the switches can be shortened. Therefore, the length of the flexible substrate to be placed between the switches can be decreased, which can miniaturize the apparatus.

According to the present invention, the excellent effect can be obtained, which enables the miniaturization of a housing in which a slide switch apparatus is mounted.

EMBODIMENT 1

[1. General Configuration]

FIG. 1 shows an outer appearance of a photographing apparatus with a slide switch apparatus of Embodiment 1 mounted thereon. In the present embodiment, a digital still camera is illustrated as an exemplary photographing apparatus.

In FIG. 1, a camera body 1 is composed of, for example, a digital still camera. A housing composed of a front case 3 and a rear case 4 contains various kinds of circuit boards, photographing elements, and the like. Furthermore, various kinds of operation portions such as a release button 5 are provided on an upper surface of the camera body 1. In the present embodiment, although the front case 3 and the rear case 4 constitute a housing, the present invention is not limited thereto.

A lens unit 2 is placed on the front case 3 of the camera body 1, and contains a lens group such as a focus lens and a zoom lens. The lens unit 2 has a substantially cylindrical shape, and has a space for accommodating lenses. On a lens ring 11 included in the lens unit 2, a slide switch portion 6 is placed so as to be slidable in an arrow S or T direction.

When the slide switch portion 6 is slid in the arrow S or T direction, a switching operation with a predetermined function in the camera body 1 can be performed. For example, switching between an automatic focus and a manual focus, switching of an aspect ratio of a photographing image, and the like can be performed.

[2. Configuration of Slide Switch Apparatus]

Next, a detailed configuration of the slide switch apparatus will be described.

Figure 2:
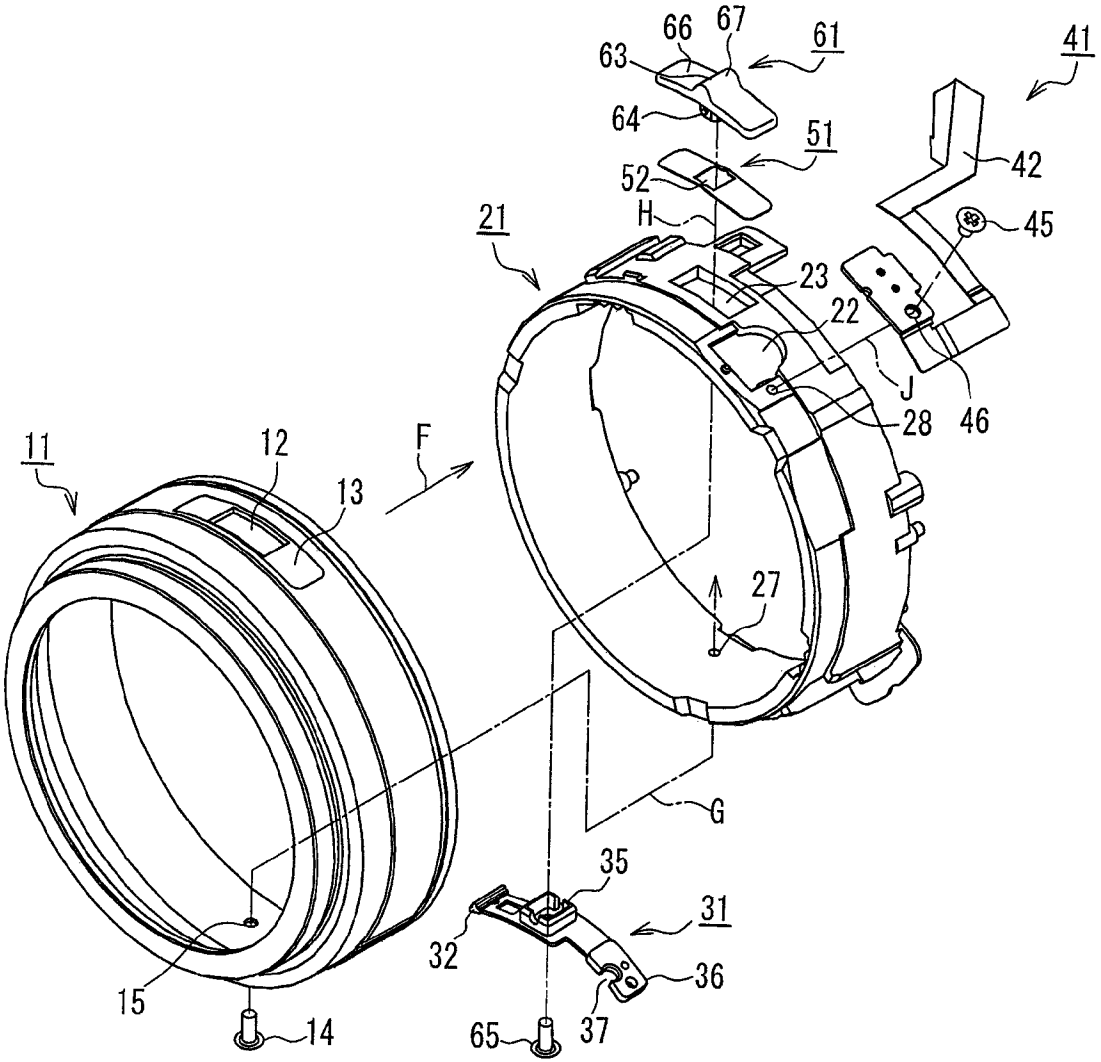
FIG. 2 is an exploded perspective view of the slide switch apparatus in Embodiment 1.
Figure 3:
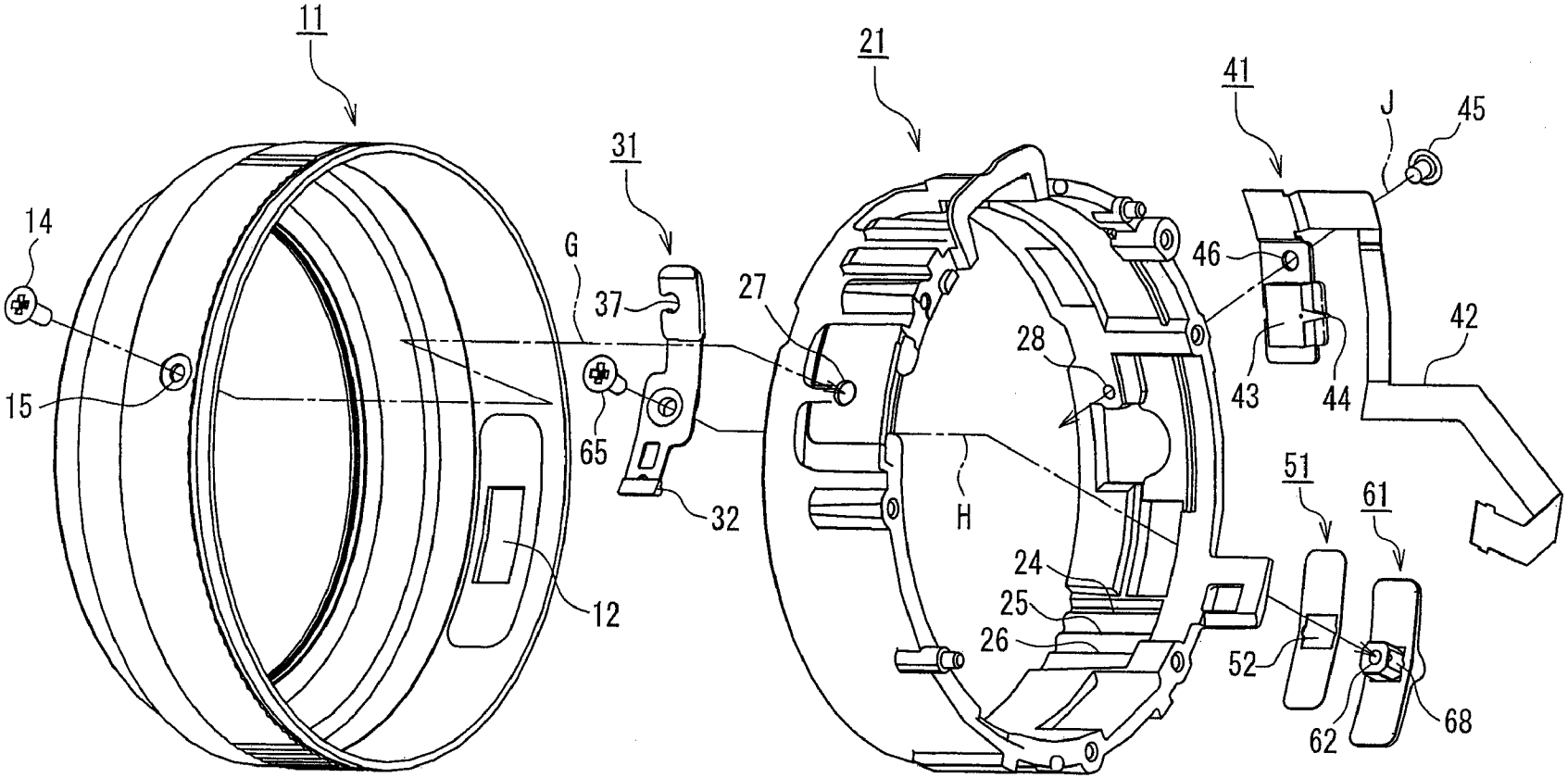
FIG. 3 is an exploded perspective view of the slide switch apparatus in Embodiment 1.

FIGS. 2 and 3 are exploded perspective views of the lens unit 2 including the slide switch apparatus. The drawings and the description of the configuration, which are not required in the present embodiment, will be omitted. Furthermore, FIGS. 2 and 3 are views with the viewing angle varied.

As shown in FIGS. 2 and 3, the lens unit 2 mainly includes the lens ring 11, a lens frame 21, a click spring 31, a flexible printed circuit board unit (hereinafter, referred to as an "FPC unit") 41, a sliding sheet 51, and a slide knob 61.

The lens ring 11 (first housing) has a substantially cylindrical shape, and is placed on an outermost peripheral side of the lens unit 2. Furthermore, on a cylindrical surface of the lens ring 11, a hole 12, a sliding portion 13, and a hole 15 are formed. Furthermore, although the lens ring 11 is made of metal such as aluminum in the present embodiment, it may be made of another material.

The hole 12 is formed so as to allow the lens ring 11 and the lens frame 21 to hold the click spring 31, the slide knob 61, and the like. The size of the hole 12 is set so that at least a positioning rib 35 placed on the click spring 31 can be inserted through the hole 12. Furthermore, the hole 12 is formed as a long hole so that the positioning rib 35 can move in accordance with the movement of the click spring 31 in the slide direction.

The sliding portion 13 is formed on the periphery of the hole 12, and is formed so as to be recessed from an outer circumferential cylindrical surface of the lens ring 11. The size of the sliding portion 13 is set in a range capable of containing the slide knob 61 and allowing the slide knob 61 to move. The depth of the sliding portion 13 may be set in such a manner that, when the slide knob 61 is mounted on the lens unit 2, a principal plane 66 of the slide knob 61 is substantially flush with the outer circumferential cylindrical surface of the lens ring 11.

A screw 14 is inserted through the hole 15, and screwed in a screw hole 27 formed in the lens frame 21, whereby the lens ring 11 can be fixed to the lens frame 21.

The lens frame 21 (second housing) has a substantially cylindrical shape, and is placed in the lens ring 11. The lens frame 21 is provided with a hole 22, a hole 23, a first click groove 24, a second click groove 25, a third click groove 26, the screw hole 27, and a screw hole 28.

The hole 22 is formed in a size capable of allowing at least a slide switch 43 to be placed therein. When the FPC unit 41 is mounted on the lens frame 21, the slide switch 43 is placed in the hole 22.

The hole 23 is formed at a position overlapping the hole 12 on a projected plane, when the lens ring 11 is attached to the lens frame 21. Furthermore, the hole 23 is formed so as to allow the lens ring 11 and the lens frame 21 to hold the click spring 31 and the slide knob 61. The size of the hole 23 is substantially equal to that of the hole 12. Furthermore, the hole 23 is made of a long hole so that the positioning rib 35 can move in accordance with the slide operation of the click spring 31.

The first click groove 24, the second click groove 25, and the third click groove 26 are formed substantially in parallel to each other, and in a direction substantially perpendicular to the slide direction of the click spring 31. Furthermore, the click grooves 24 to 26 can position the slide knob 61 at a plurality of places (three in the present embodiment) when a protrusion 32 placed on the click spring 31 is fitted selectively in one of the click grooves 24 to 26, and generates a click feeling during a slide operation.

The screw hole 27 is a hole in which the screw 14 is screwed. The screw hole 28 is a hole in which a screw 45 is screwed.

Figure 4:
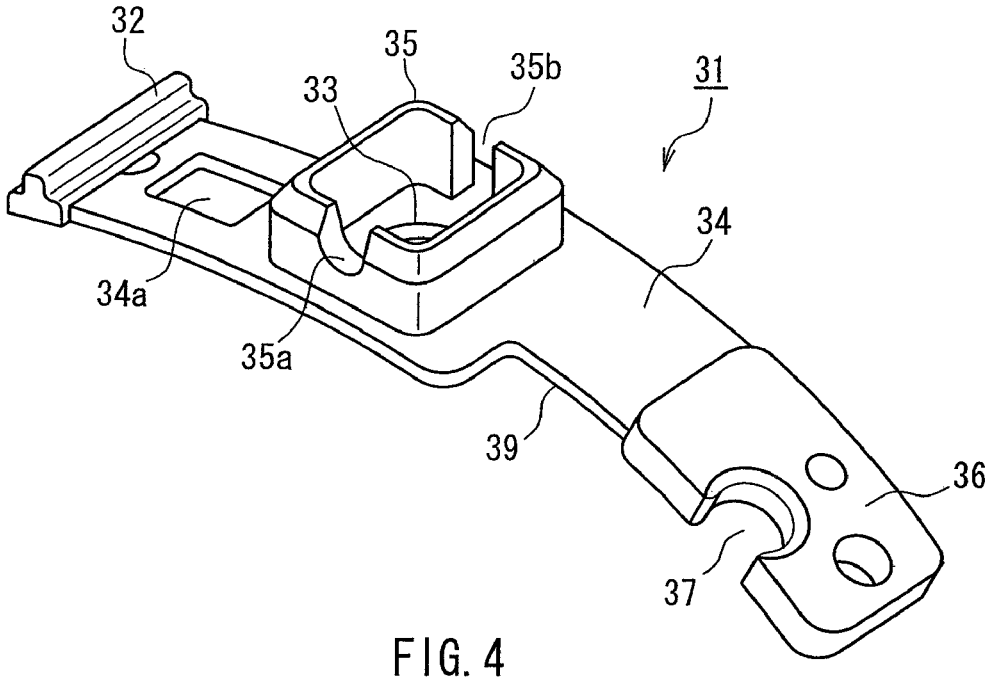
FIG. 4 is a perspective view of a click spring in Embodiment 1.
Figure 5:
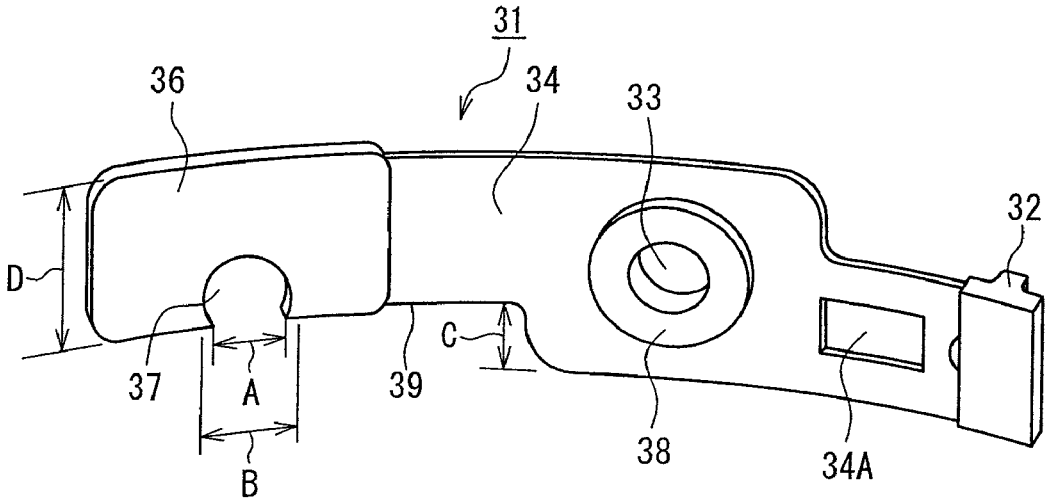
FIG. 5 is a perspective view of the click spring in Embodiment 1.

The click spring 31 (slide member) is configured as shown in FIGS. 4 and 5. FIG. 4 is a perspective view of an upper surface side of the click spring 31. FIG. 5 is a perspective view of a bottom surface side of the click spring 31. Furthermore, the click spring 31 includes the protrusion 32, a hole 33, a plate spring portion 34, the positioning rib 35, an engagement portion 36, an engagement concave portion 37, a screwing surface 38, and a concave portion 39.

The protrusion 32 (click portion) is placed at one end of the plate spring portion 34. The protrusion 32 is provided so as to protrude substantially in the same direction as the direction in which the positioning rib 35 protrudes. The protrusion 32 is fitted in any of the click grooves 24 to 26, when the slide knob 61 is slid. Furthermore, although the tip end of the protrusion 32 is formed in a mountain shape, the present invention is not limited thereto, and the protrusion 32 may be formed at least so as to be fitted in any of the click grooves 24 to 26. Furthermore, in the present embodiment, although the protrusion 32 is formed by insert-molding of resin with respect to the plate spring portion 34, the present invention is not limited thereto.

The hole 33 is formed substantially at the center of the plate spring portion 34. When the click spring 31 is fixed to the lens frame 21 with a screw 65, the screw 65 is inserted through the hole 33.

The plate spring portion 34 (substrate) can be deformed elastically. The protrusion 32 is placed at one end of the plate spring portion 34, and the engagement portion 36 is placed at the other end thereof. The positioning rib 35 is placed between the protrusion portion 32 and the engagement portion 36. Furthermore, the plate spring portion 34 is made of a metallic plate in the present embodiment. This can reduce the degradation of a crisp operation feeling as a result of repeated use. Furthermore, the plate spring portion 34 may be in a flat shape, or may be bent previously so as to follow the inner surface of the lens frame 21. In this case, it is preferable that the plate spring portion 34 is previously bent, and thereafter, the protrusion 32, the engagement portion 36, and the positioning rib 35 may be formed on the plate spring portion 34. As a result, the protrusion 32 and the like become unlikely to be damaged, compared with the case where the plate spring portion 34 is bent after the protrusion 32 and the like are formed. This facilitates the bending of the plate spring portion 34. In the plate spring portion 34, the surface on which the positioning rib 35 is formed is defined as a first surface, and a reverse surface side of the first surface is defined as a second surface.

The positioning rib 35 (portion to be held) is placed on the periphery of the hole 33 on the plate spring portion 34. The positioning rib 35 is fitted in the hole 23, when the click spring 31 is mounted on the lens frame 21. The positioning rib 35 moves in the hole 23 in accordance with the slide operation of the slide knob 61. As shown in FIGS. 4 and 5, the positioning rib 35 is placed between the protrusion 32 and the engagement portion 36 in the slide direction (longitudinal direction) of the click spring 31.

The engagement portion 36 is made of resin, and switches the slide switch 43 in accordance with the slide operation of the click spring 31. In the present embodiment, it is preferable that the engagement portion 36 is formed by insert-molding of resin, using the plate spring portion 34 as an insert. This is because the engagement portion 36 can be formed easily. However, the present invention is not limited to this configuration.

The protrusion 32, the positioning rib 35, and the engagement portion 36 may be made of, for example, polyoxymethylene (POM: polyacetal resin). Since they are made of POM, the slidability of the click spring 31 with respect to the lens frame 21 becomes satisfactory. Therefore, the durability of the click spring 31 and/or the lens frame 21 becomes satisfactory. However, the present invention is not limited to this material.

Furthermore, the protrusion 32, the positioning rib 35, and the engagement portion 36 may be formed by insert-molding of resin at one time, using the plate spring portion 34 as an insert. Because of this, the protrusion 32 and the like can be formed at one time, which makes it easy to produce the click spring 31.

The engagement concave portion 37 is formed substantially in an Ω shape in the engagement portion 36. In the engagement concave portion 37, the switch lever 44 of the slide switch 43 is fitted. An inner diameter A of the end of the engagement concave portion 37 is smaller than a maximum inner diameter B of the engagement concave portion 37. In the present embodiment, the engagement concave portion 37 is formed in an Ω shape. However, the engagement concave portion 37 may be formed in other shapes, as long as it allows at least the switch lever 44 to be fitted, and allows the switch lever 44 to perform a switching operation.

The screwing surface 38 is formed on the periphery of the hole 33 on the second surface of the plate spring portion 34. Furthermore, the screwing surface 38 is formed so as to tilt with respect to the second surface of the plate spring portion 34. Furthermore, the screwing surface 38 is a portion where the head of the screw 65 is positioned, when the click spring 31 is fixed to the lens frame 21 with the screw 65. Since the screwing surface 38 is formed so as to tilt, even in the case where the screw 65 is screwed in diagonally, a gap is not formed between the head of the screw 65 and the screwing surface 38. Therefore, in the case where the screw 65 is screwed in diagonally, the screw 65 can be fastened exactly.

Figure 6:
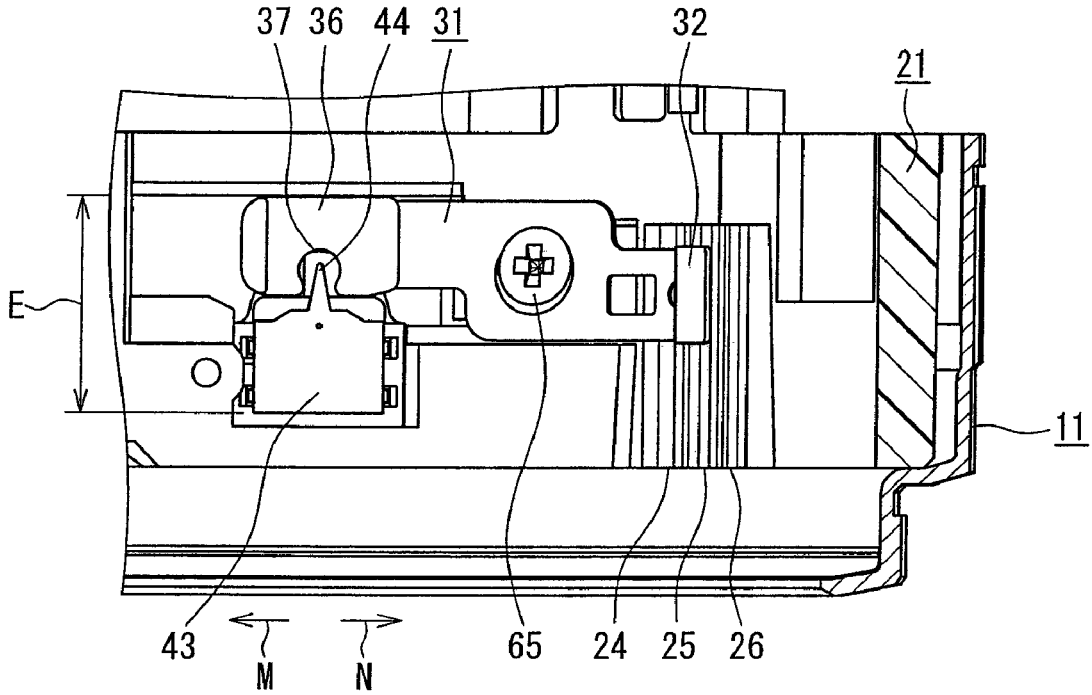
FIG. 6 is a partial cross-sectional view of a lens unit in Embodiment 1.

The concave portion 39 is formed by cutting away a portion between the positioning rib 35 and the engagement portion 36 in the plate spring portion 34 in the width direction of the plate spring portion 34. When the click spring 31 is fixed to the lens frame 21, a part or entirety of the slide switch 43 is placed in the concave portion 39, as shown in FIG. 6. More specifically, the click spring 31 and the slide switch 43 are placed so that they overlap each other in the width direction of the click spring 31. Because of this, a width E from the end of the click spring 31 to the end of the slide switch 43 can be decreased.

In FIGS. 2 and 3, the FPC unit 41 includes an FPC 42, the slide switch 43, and a hole 46.

The FPC 42 connects the slide switch 43 to the other circuits electrically. An example of the other circuits includes a control circuit in the camera body 1. A ground line included in the FPC 42 may be configured so as to come into electrical contact with the lens ring 11, when the FPC unit 41 is placed between the lens ring 11 and the lens frame 21.

The slide switch 43 is fixed to a principal plane of the end of the FPC 42. Furthermore, the switch lever 44 (portion to be acted on) protrudes from the slide switch 43. Furthermore, the slide switch 43 is composed of a self-reset type switching element with the switch lever 44 biased to a neutral position in the present embodiment. Because of this, even if there is a gap between the engagement concave portion 37 and the switch lever 44, since the switch lever 44 is biased toward the neutral position, the switch lever 44 is positioned, and a stable switching operation can be performed. Furthermore, as the slide switch 43, a three-position switching element having three internal contacts is used in the present embodiment. However, the present invention is not limited thereto.

The switch lever 44 is fitted in the engagement concave portion 37 formed in the click spring 31. When the slide knob 61 is slid under the condition that the switch lever 44 is fitted in the engagement concave portion 37, the switch lever 44 is rotated in an arrow M or N direction in FIG. 6 in accordance with the slide operation of the click spring 31. Because of this, the internal contact of the slide switch 43 is switched.

When the screw 45 is inserted through the hole 46, and screwed in the screw hole 28 formed in the lens frame 21, the FPC 42 can be fixed to the lens frame 21.

The sliding sheet 51 is placed so as to be sandwiched between the slide knob 61 and the lens ring 11. Furthermore, the sliding sheet 51 has a sheet shape, and the front and back surfaces thereof are composed of a material with low friction. By placing the sliding sheet 51, the slide operation of the slide knob 61 can be smoothened, and the damage or friction caused by the sliding between the slide knob 61 and the lens ring 11 can be prevented. Furthermore, a hole 52 is formed on the sliding sheet 51.

The hole 52 is a hole through which a boss 64 formed on the slide knob 61 is inserted, when the slide knob 61 is mounted on the lens frame 21. This can position the sliding sheet 51 and the slide knob 61 with each other.

The slide knob 61 includes a screw hole 62, a guideline groove 63, the boss 64, and a protrusion 67. The slide knob 61 is exposed to the outside, and is slid by a user, under the condition of being attached to the apparatus. In the slide knob 61, a surface on which the protrusion 67 is provided (surface exposed to the outside) is defined as a first surface, and a reverse surface of the first surface is defined as a second surface.

The screw hole 62 is formed substantially at the center of the boss 64 formed on the second surface of the slide knob 61, and allows the screw 65 to be screwed therein.

The guideline groove 63 is formed in a short-side direction of the slide knob 61 at a top of the protrusion 67.

The boss 64 protrudes from the second surface of the slide knob 61, and is fitted in the positioning rib 35 formed on the click spring 31, whereby the slide knob 61 and the click spring 31 can be positioned with each other.

The screw 65 is inserted through the holes 33, 23, and 52, and screwed in the screw hole 62 formed in the slide knob 61, whereby the click spring 31, the sliding sheet 51, and the slide knob 61 can be held movably by the lens ring 11 and the lens frame 21.

The protrusion 67 protrudes from the first surface of the slide knob 61, and a user hooks the slide knob 61 with the finger when sliding it, whereby a slide operation can be performed easily.

[3. Method of Assembling Slide Switch Apparatus]

A method for assembling a slide switch apparatus with the above configuration will be described.

In FIG. 2, first, the FPC unit 41 is attached to the lens ring 21. Specifically, the FPC unit 41 is placed on an outer circumferential cylindrical surface of the lens ring 21. At this time, the slide switch 43 is placed in the hole 22. Next, the screw 45 is inserted through the hole 46 in accordance with a path represented by an arrow J, and is screwed in the screw hole 28. This can fix the FPC unit 41 to the lens ring 21.

Next, the lens ring 11 is attached to the lens frame 21. Specifically, the lens ring 11 is moved in the direction represented by the arrow F, and covers the outer circumferential cylindrical surface of the lens frame 21. At this time, the lens ring 11 and the lens frame 21 are placed so that the holes 12 and 23 overlap each other on a projected plane. Although not shown, engagement portions that can be engaged with each other are provided on an inner circumferential cylindrical surface of the lens ring 11 and the outer circumferential cylindrical surface of the lens frame 21, and they are fixed provisionally by engaging both the engagement portions. Next, the screw 14 is inserted through the hole 15 to be screwed in the screw hole 27 in accordance with a path represented by an arrow G. This can attach the lens ring 11 to the lens frame 21.

Next, the click spring 31, the sliding sheet 51, and the slide knob 61 are attached to the lens frame 21. Specifically, the boss 64 formed on the second surface of the slide knob 61 is inserted through the hole 52 of the sliding sheet 51, whereby the sliding sheet 51 is positioned with respect to the slide knob 61. Next, the boss 64 is inserted through the holes 12 and 23, whereby the slide knob 61 is placed on the sliding portion 13. At this time, the slide knob 61 is placed so that the second surface of the slide knob 61 and the sliding portion 13 sandwich the sliding sheet 51. The sliding sheet 51 merely may be positioned by the boss 64, or may be attached to the second surface of the slide knob 61. Next, the click spring 31 is placed on the inner circumferential cylindrical surface of the lens frame 21. At this time, the click spring 31 is placed so that the positioning rib 35 and the boss 64 are fitted in each other. Furthermore, the switch lever 44 is fitted in the engagement concave portion 37.

Furthermore, in the present embodiment, the slide switch 43 is a self-reset type switching element. Before the engagement concave portion 37 is engaged with the switch lever 44, the switch lever 44 is always placed at a neutral position. Therefore, if the switch lever 44 is placed at the neutral position, the engagement concave portion 37 can be engaged with the switch lever 44 without fail. Thus, the operation of placing the click spring 31 can be facilitated.

Next, the screw 65 is inserted successively through the hole 33 of the click spring 31, the hole 23 of the lens frame 21, the hole 12 of the lens ring 11, and the hole 52 of the sliding sheet 51 as represented by an arrow H, thereby being screwed in the screw hole 62 of the slide knob 61. This enables the click spring 31, the sliding sheet 51, and the slide knob 61 to be attached to the lens frame 21.

FIG. 6 shows an inner side of the lens unit 2 under the condition that the click spring 31 is attached to the lens frame 21. FIG. 6 illustrates the lens ring 11 and the lens frame 21 under the condition of being partially cut away so as to clearly display the configuration. As shown in FIG. 6, the switch lever 44 is fitted in the engagement concave portion 37, and the protrusion 32 is fitted in a click groove (the second click groove 25 in the figure).

The screw hole 62 is formed in a direction tilting slightly in an optical axis direction, without being formed in a direction orthogonal to the lens optical axis 7. Thus, the screw 65 can be screwed in the screw hole 62 by inserting a driver in the lens unit 2 in a diagonal direction. The reason for this will be described below.

Figure 7:
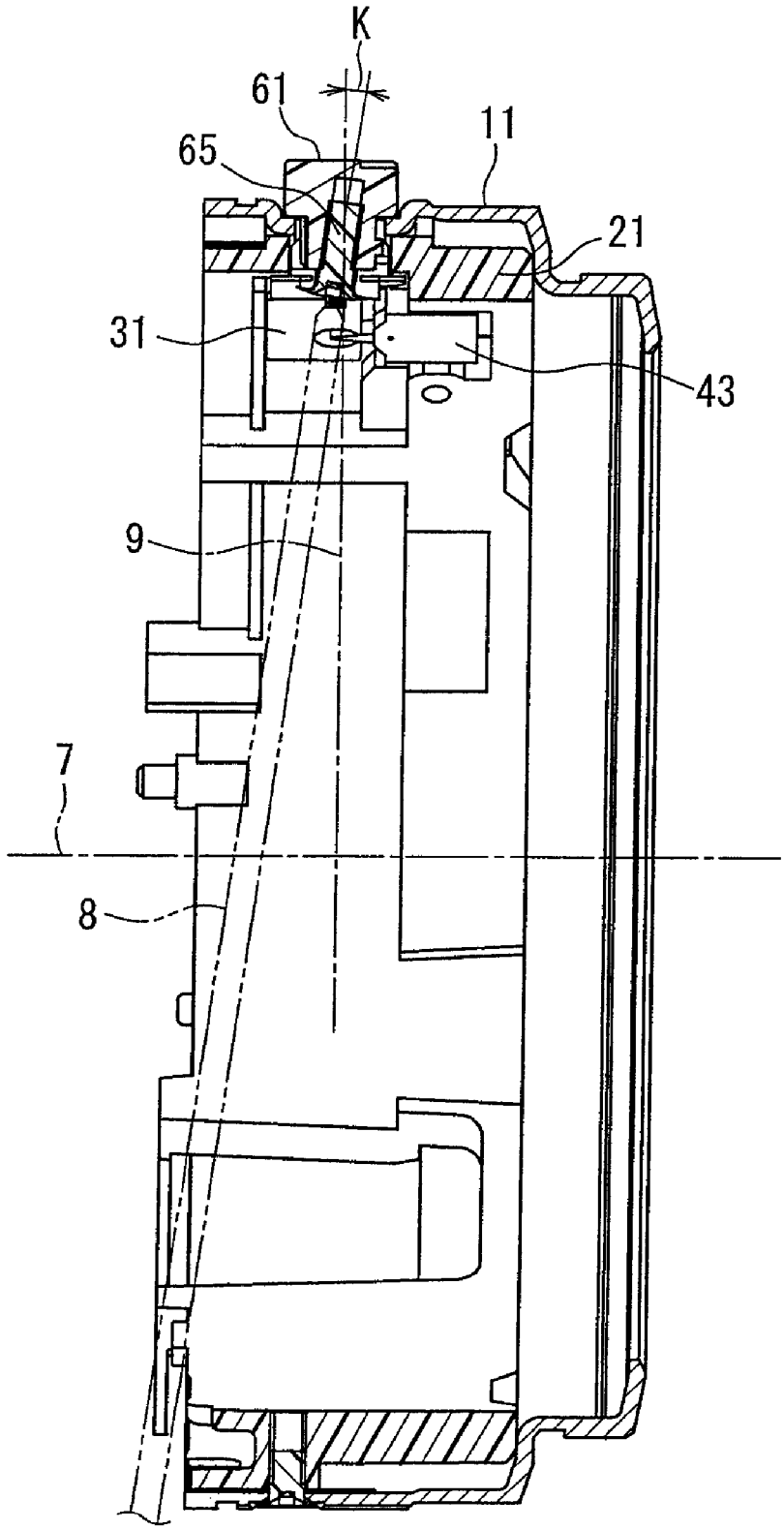
FIG. 7 is a cross-sectional view of the lens unit in Embodiment 1.
Figure 8:
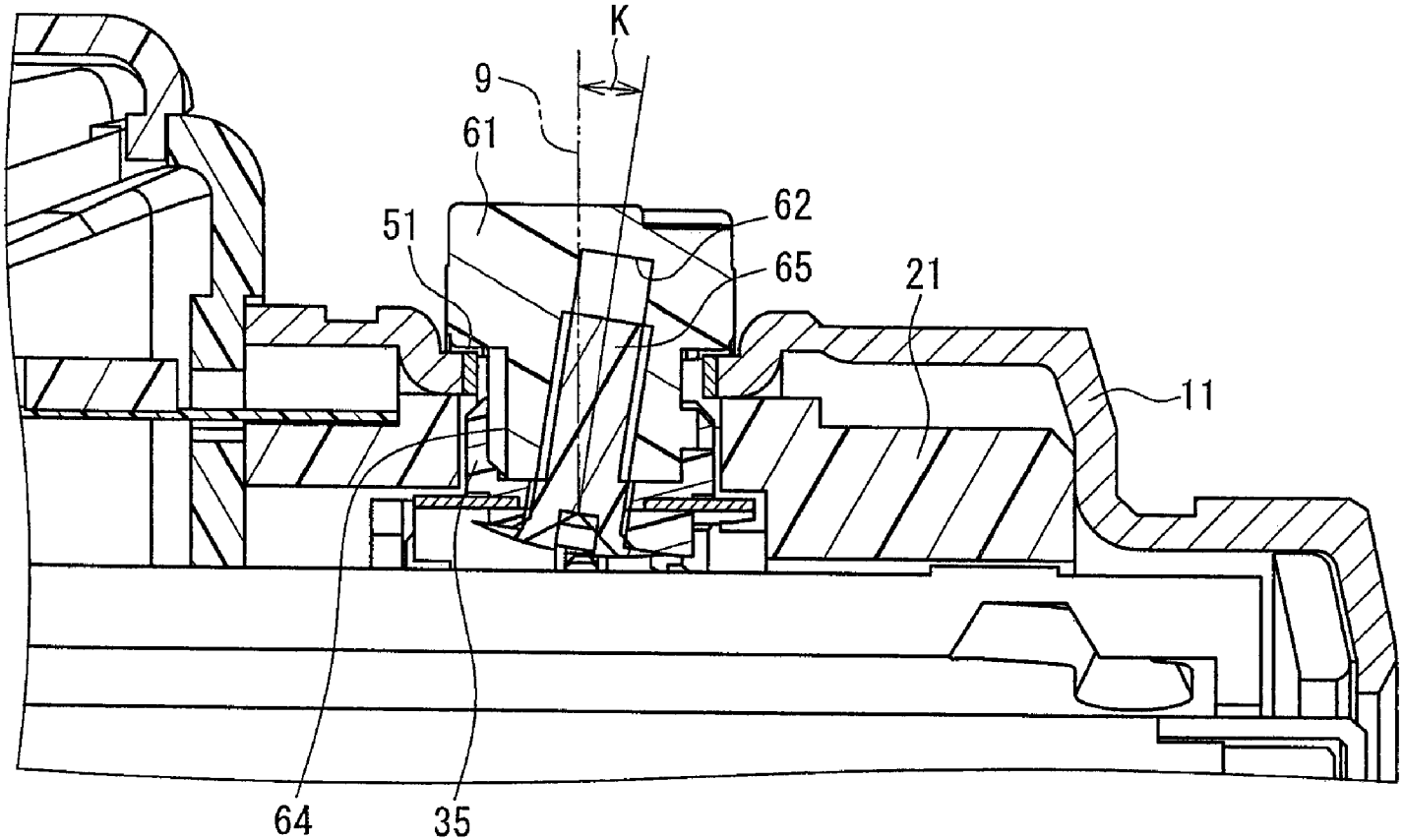
FIG. 8 is a partial cross-sectional view of the lens unit in Embodiment 1.

FIG. 7 is a cross-sectional view taken along a line X-X in FIG. 1. Furthermore, FIG. 8 is an enlarged view of the periphery of the slide knob 61 in FIG. 7. As shown in FIGS. 7 and 8, the screw hole 62 is formed so as to tilt slightly in the optical axis direction, instead of being orthogonal to the lens optical axis 7. Specifically, as shown in FIGS. 7 and 8, the screw hole 62 tilts by an angle K with respect to a line 9 orthogonal to the lens optical axis 7. Due to such a configuration, the screw 65 can be screwed in the screw hole 62 by inserting a driver 8 for screwing the screw 65 from an opening on the camera body side in the lens unit 2.

If the screw hole 62 is formed so as to be orthogonal to the lens optical axis 7, the screw 65 must be screwed in the screw hole 62 from a direction orthogonal to the lens optical axis 7. However, the inner diameter of the lens unit 2 is relatively small, and the general driver 8 has a length larger than the inner diameter of the lens unit 2. Therefore, it is difficult to insert the driver 8 inside the lens unit 2 from the direction orthogonal to the lens optical axis 7. Thus, it is difficult to screw the screw 65 in the screw hole 62 from the direction orthogonal to the lens optical axis 7 by the driver 8. In the above configuration, if an attempt is made to screw the screw 65 in the screw hole 62 by inserting the driver 8 from the diagonal direction with respect to the axis direction of the screw 65, a groove for driver fitting formed at the head of the screw 65 may be crushed by mistake.

In the present embodiment, the screw hole 62 is formed so as to tilt, whereby the driver 8 can be inserted in the lens unit 2 diagonally to screw the screw 65 in the screw hole 62 exactly.

[4. Operation of Slide Switch Apparatus]

Figure 9:
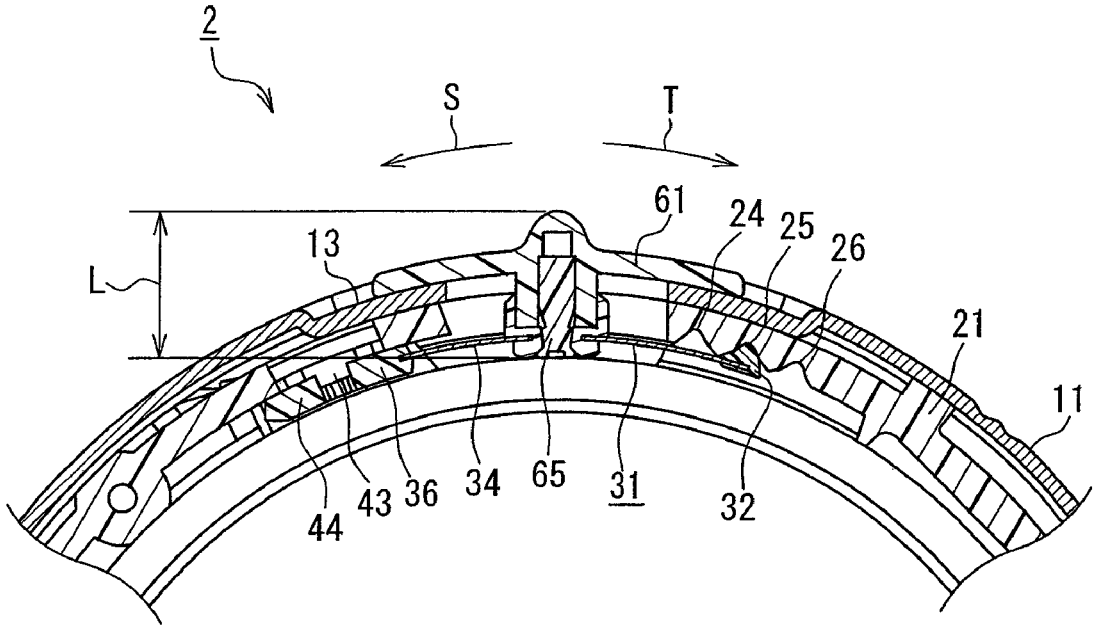
FIG. 9 is a cross-sectional view of the slide switch apparatus in Embodiment 1 (second position).
Figure 10A:
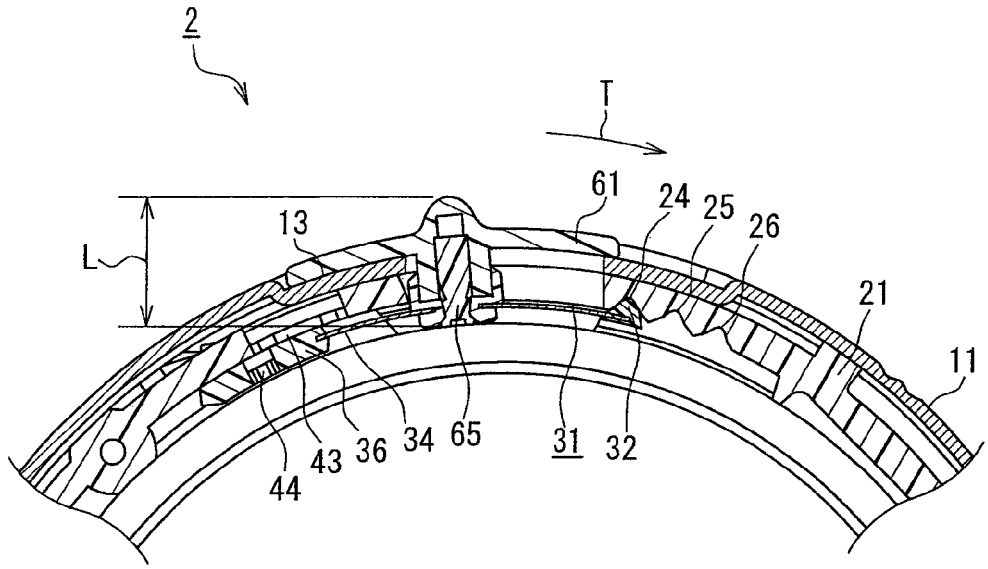
FIG. 10A is a cross-sectional view of the slide switch apparatus in Embodiment 1 (first position).
Figure 10B:
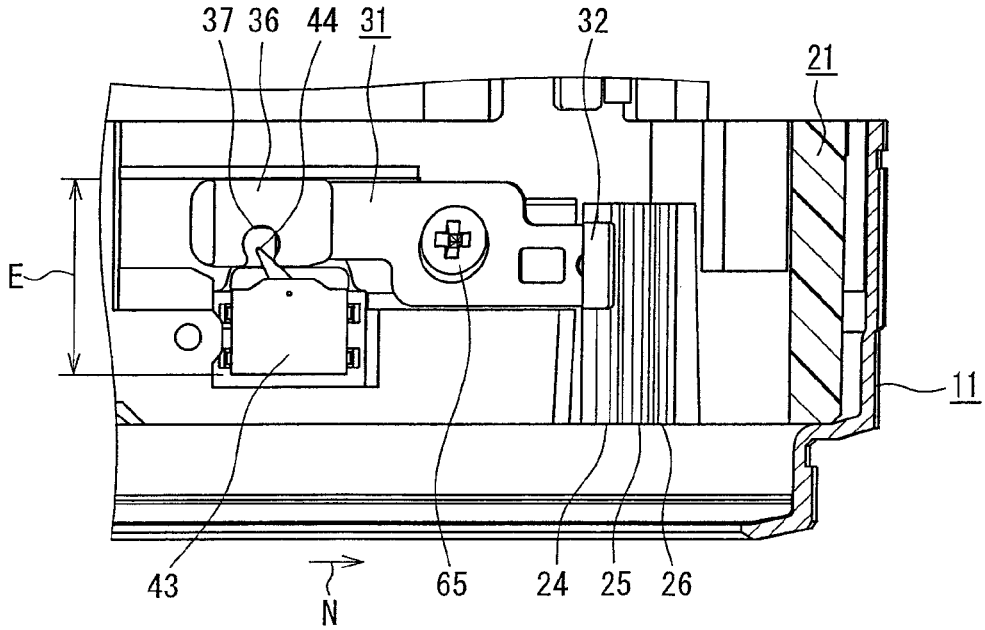
FIG. 10B is a cross-sectional view of the slide switch apparatus in Embodiment 1 first position).
Figure 11A:
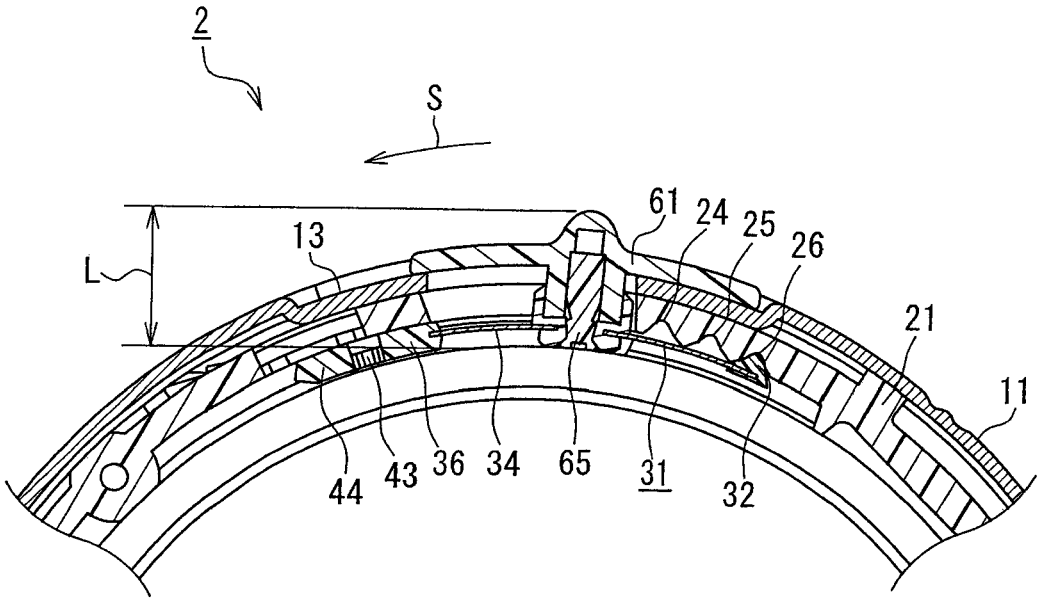
FIG. 11A is a cross-sectional view of the slide switch apparatus in Embodiment 1 (third position).
Figure 11B:
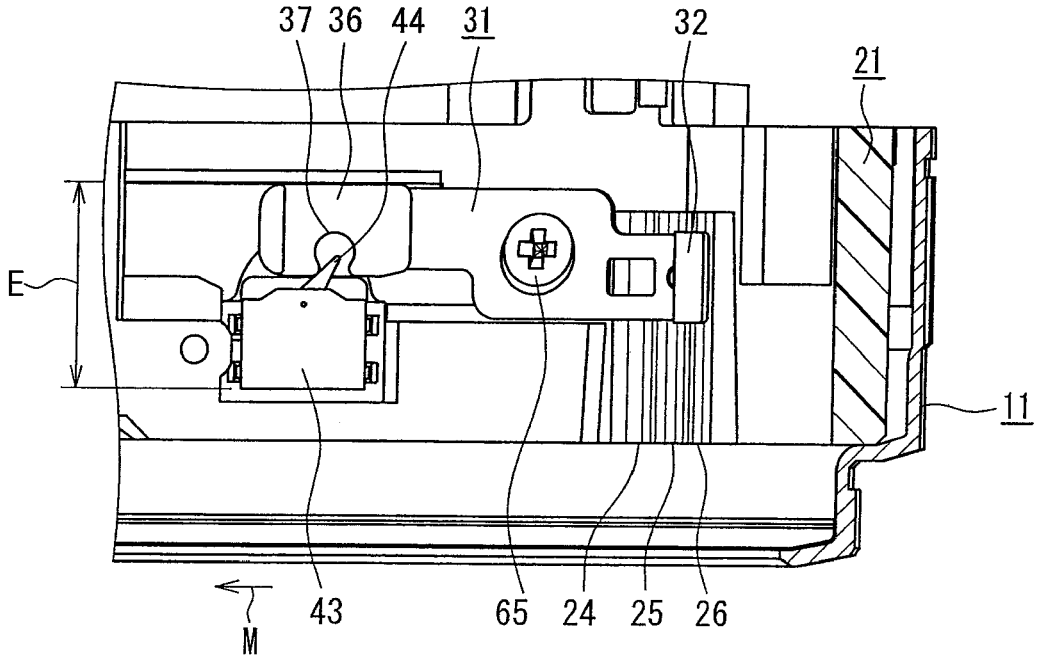
FIG. 11B is a cross-sectional view of the slide switch apparatus in Embodiment 1 (third position).

FIG. 9 is a cross-sectional view taken along a line Y-Y in FIG. 1, showing the configuration of the slide switch apparatus. FIG. 9 shows the state where the protrusion 32 is fitted in the second click groove 25, and this position is defined as a "second position". When the slide knob 61 is at the second position, the switch lever 44 is at a neutral position as shown in FIG. 6. FIGS. 10A and 10B show a state where the slide knob 61 has slid in the arrow S direction from the second position, and this position is defined as a "first position". Furthermore, FIGS. 11A and 11B show a state where the slide knob 61 has slid in the arrow T direction from the second position, and this position is defined as a "third position". FIGS. 10B and 11B are drawn at the same angle as that in FIG. 6.

Figure 12:
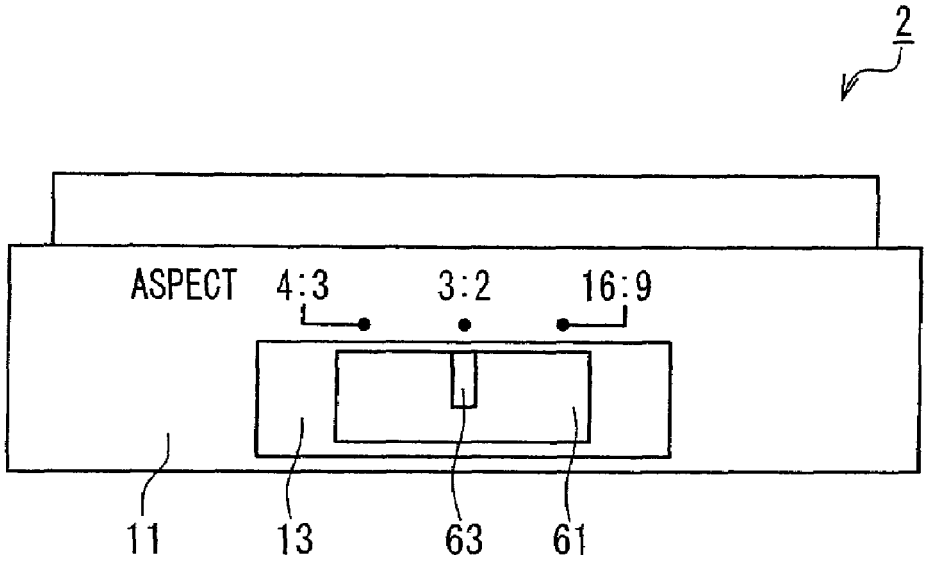
FIG. 12 is a side view of the lens unit in Embodiment 1.

Furthermore, in the present embodiment, a three-position switching element is used as the slide switch 43, and the slide switch 43 can switch, for example, the aspect ratio of a photographing image. FIG. 12 is a side view of the lens unit. In FIG. 12, when the slide knob 61 is at the first position, the aspect ratio is set to be "4:3"; when the slide knob 61 is at the second position (position shown in FIG. 12), the aspect ratio is set to be "3:2"; and when the slide knob 61 is at the third position, the aspect ratio is set to be "16:9". For ease of visual inspection of the selection situation of each aspect ratio, a mark, a character, or the like is displayed in the vicinity of the slide knob 61 in the lens ring 11. In the present embodiment, as shown in FIG. 12, a character such as "4:3" is displayed. By positioning the guideline groove 63 formed on the slide knob 61 to the mark or the character, a desired function can be selected. The function that can be switched by the slide switch 43 may be assigned other functions, instead of the aspect ratio of a photographing image.

Hereinafter, the operation will be described.

First, at the second position shown in FIG. 9, the protrusion 32 is fitted in the second click groove 25, whereby the slide knob 61 is positioned. At this time, the switch lever 44 fitted in the engagement concave portion 37 is at a neutral position. Since the switch lever 44 is at a neutral position, the second contact is turned on inside the slide switch 43, and the aspect ratio of a photographing image is set to be "3:2" by a microcomputer in the camera.

Next, when the slide knob 61 is slid in the arrow S direction from the state shown in FIG. 9, the click spring 31 placed integrally with the slide knob 61 is slid in the arrow S direction. During sliding, while the plate spring portion 34 is being deformed elastically, the protrusion 32 moves from the second click groove 25 to the first click groove 24. Furthermore, during sliding, the switch lever 44 is pressed by the engagement portion 36 to be switched to the first contact side of the slide switch 43.

As shown in FIG. 10A, when the slide knob 61 and the click spring 31 move to the first position, the protrusion 32 is fitted in the first click groove 24, and the slide knob 61 and the click spring 31 are positioned. At this time, as shown in FIG. 10B, the switch lever 44 is pressed by the engagement portion 36, and the first contact inside the slide switch 43 is turned on. Furthermore, the switch lever 44 abuts on the inner wall of the engagement concave portion 37 with the biasing force attempting to return to the neutral position, thereby suppressing any looseness between the switch lever 44 and the engagement portion 36. Because of this, the aspect ratio of a photographing image is set to be "4:3" by the microcomputer in the camera.

Furthermore, when the slide knob 61 is slid in the arrow T direction from the state shown in FIG. 9, the click spring 31 placed integrally with the slide knob 61 is slid in the arrow T direction. During sliding, while the plate spring portion 34 is being deformed elastically, the protrusion 32 moves from the second click groove 25 to the third click groove 26. Furthermore, during sliding, the switch lever 44 is pressed by the engagement portion 36 to be switched to the third contact side of the slide switch 43.

As shown in FIG. 11A, when the slide knob 61 and the click spring 31 move to the third position, the protrusion 32 is fitted in the third click groove 26, and the slide knob 61 and the click spring 31 are positioned. At this time, as shown in FIG. 11B, the switch lever 44 is pressed by the engagement portion 36, and the third contact in the slide switch 43 is turned on. Furthermore, the switch lever 44 abuts on the inner wall of the engagement concave portion 37 with the biasing force attempting to return to the neutral position, thereby suppressing any looseness between the switch lever 44 and the engagement portion 36. Because of this, the aspect ratio of a photographing image is set to be "16:9" by the computer in the camera.

[5. Effects of Embodiment, etc.]

As described above, according to the present embodiment, as shown in FIGS. 6 and 9, the engagement portion 36 and the switch lever 44 are placed so as to overlap each other in the thickness direction, whereby a dimension L in FIG. 9 can be decreased, and the slide switch apparatus can be miniaturized.

Furthermore, as shown in FIG. 5, the concave portion 39 is formed in the click spring 31, whereby a part or entirety of the slide switch 43 can be placed in the concave portion 39, and the maximum width constituted by the click spring 31 and the slide switch 43 can be decreased as shown in FIG. 6. Thus, the slide switch apparatus can be miniaturized.

Furthermore, the thickness of the engagement portion 36 is set to be larger than that of the switch lever 44. Consequently, when the switch lever 44 is slid, the switch lever 44 is unlikely to come out of the engagement portion 36, and the switching operation of the slide switch 43 can be performed exactly.

Furthermore, the engagement portion 36 is made of resin. This can reduce the friction of the switch lever 44. Furthermore, the reduction in friction can suppress dust generated when the fitted portion is scraped.

Furthermore, the engagement concave portion 37 is formed in an Ω shape. More specifically, as shown in FIG. 5, the inner diameter (an opening width dimension) A of the end of the engagement concave portion 37 and the maximum inner diameter (an opening width dimension) B of the inside thereof is set to be A<B. Consequently, the switch lever 44 is unlikely to come out of the engagement concave portion 37, and the inner wall of the engagement concave portion 37 does not interfere with the switch lever 44, so that the switching operation of the slide switch 43 can be performed exactly.

Furthermore, the sliding portion 13 composed of a concave portion is formed. Consequently, the slide knob 61 is fitted in the sliding portion 13 during assembly of the apparatus, so that the slide knob 61 can be positioned easily. Thus, the apparatus can be assembled easily.

Furthermore, a pair of ribs 68 are formed on a side surface of the boss 64 of the slide knob 61, and concave portions 35*a* and 35*b* are formed in the positioning rib 35 of the click spring 31, whereby the ribs 68 may be fitted in the concave portions 35*a* and 35*b* during assembly of the apparatus. Consequently, the slide knob 61 can be positioned with respect to the click spring 31, and the apparatus can be assembled easily.

Furthermore, as shown in FIG. 7, the screw hole 62 in the slide knob 61 is formed so as to tilt, whereby the screw 65 can be screwed in the screw hole 62 by inserting the driver 8 diagonally with respect to the lens unit 2. Thus, the apparatus can be assembled easily.

Furthermore, the hole 34*a* is formed in the plate spring portion 34, whereby a click feeling can be adjusted. More specifically, as the size of the hole 34*a* is decreased, the spring rate in the portion between the protrusion 32 in the plate spring portion 34 and the positioning rib 35 can be enhanced, whereby a click feeling can be enhanced. Furthermore, as the size of the hole 34*a* is increased, the spring rate in the portion between the protrusion 32 in the plate spring portion 34 and the positioning rib 35 can be decreased, whereby the slide knob 61 can be slid easily. That is, the slide knob 61 can be slid with a small force.

Furthermore, the slide switch 43 is composed of a self-reset type switching element, whereby the looseness of the switch lever 44 can be suppressed when the switch lever 44 is placed at the first position or the third position. Furthermore, when the switch lever 44 is not supplied with a load, the switch lever 44 is always at a neutral position. Therefore, the self-reset type switching element can specify the position of the click spring 31 with respect to the slide switch 43, whereby the assembling operation can be enhanced.

Furthermore, the protrusion 32, the positioning rib 35, and the engagement portion 36 are formed by insert-molding of resin, whereby an assembling operation can be enhanced.

Furthermore, the FPC unit 41 is placed between the lens ring 11 and the lens frame 21, so that the FPC unit 41 can be protected from an external shock. Furthermore, the ground line in the FPC unit 41 is connected electrically to the lens ring made of metal, whereby the slide switch 43 can be grounded with a simple configuration.

Furthermore, the FPC unit 41 is wired from between the lens ring 11 and the lens frame 21 to the camera body side, so that the optical path of incident light in the lens unit 2 is not adversely influenced, and a decrease in photographing image quality can be prevented. More specifically, when the FPC unit 41 is wired inside (to the lens side) of the lens frame 21, the FPC unit 41 interferes with the optical path of incident light, and incident light is reflected from the surface of the FPC 42, which decreases image quality. However, such a problem does not occur in the present embodiment.

In the present embodiment, a pair of ribs 68 are provided, and the concave portions 35*a* and 35*b* are formed so as to correspond to the pair of ribs 68. However, one rib and one concave portion may be formed. Consequently, the attachment direction of the slide knob 61 with respect to the click spring 31 is determined, so that the apparatus can be assembled easily.

Furthermore, in the present embodiment, although the slide switch 43 having the switch lever 44 is used as the switch of the present invention, the present invention is not limited thereto. For example, a push-type switch having a push button may be used. In this case, the push button corresponds to the portion to be acted on in the present invention, and the push button is driven by the engagement portion 36, whereby the operation state of the push-type switch can be switched. Alternatively, a non-contact type switch may be used as the switch of the present invention. In this case, a photodetector or the like corresponds to the portion to be acted on in the present invention, and the engagement portion 36 cuts off light, whereby the operation state of the switch is switched.

Furthermore, in the present embodiment, the protrusion 32 is used as the click portion of the present invention and brought into contact with the lens frame 21, whereby a click feeling is generated. However, the present invention is not limited thereto. For example, the following configuration may be used: an elastic member is provided in the width direction of a slide member; a wave-shaped concave portion, having alternating wide sites and narrow sites, is provided on the lens frame 21; and a slide member is accommodated in the concave portion. In this case, the side wall of the wave-shaped concave portion comes into contact with the elastic member, whereby the displacement amount of the elastic member changes in accordance with the movement of the slide member, so that a click feeling is generated. Furthermore, the click portion may be brought into contact with the other members, instead of the lens frame 21. In short, any click portion may be used as long as it can generate a click feeling in accordance with the movement of the slide member.

Furthermore, in the present embodiment, the protrusion 32 and the engagement portion 36 are placed at the ends of the plate spring portion 34. However, it is not required according to the present invention that these members are placed at the ends. In short, the positioning rib 35 only need to be placed between the protrusion 32 and the engagement portion 36.

EMBODIMENT 2

Embodiment 1 shows the configuration in which one slide switch apparatus is mounted on the lens unit. Embodiment 2 shows a configuration in which a plurality of slide switch apparatuses are mounted on the lens unit.

Figure 13:
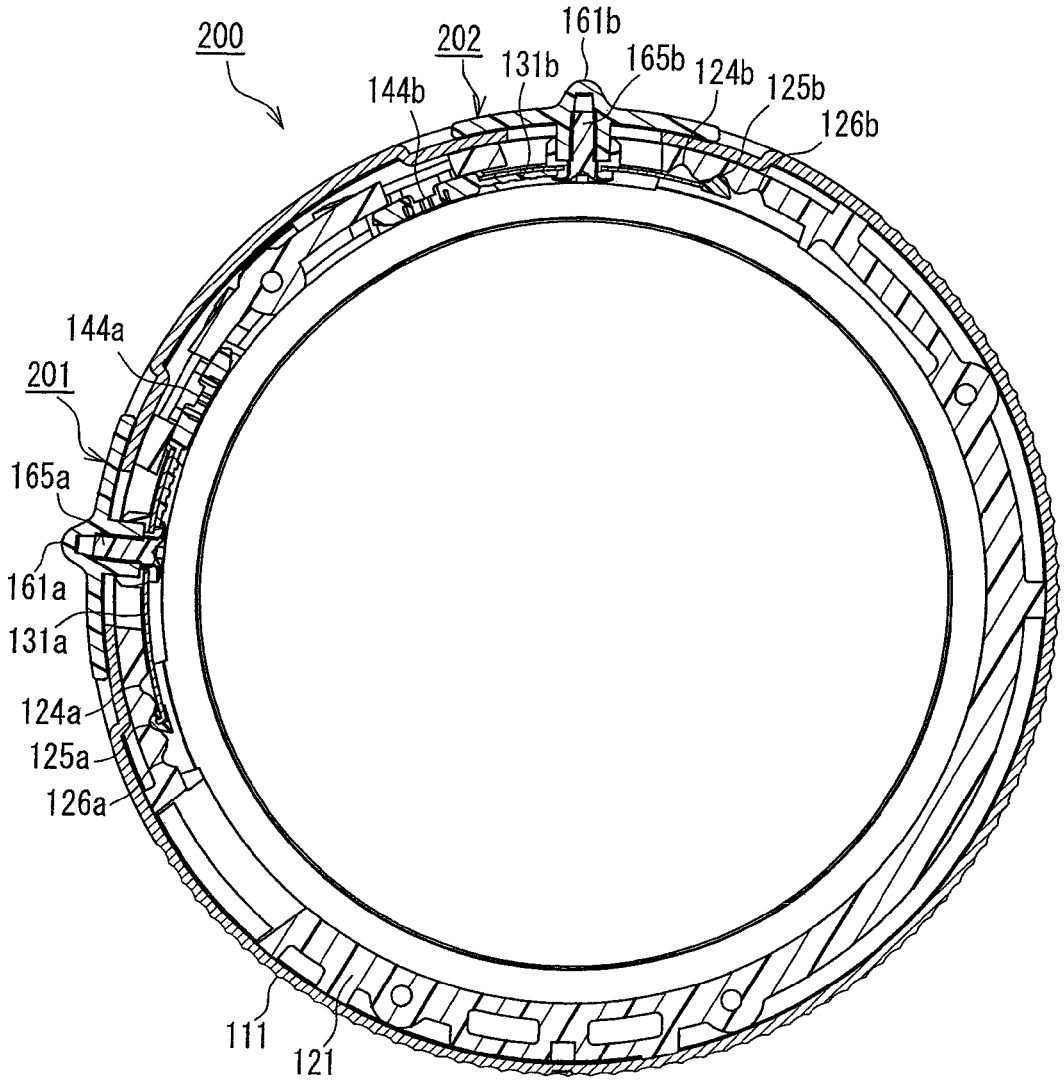
FIG. 13 is a cross-sectional view of a lens unit in Embodiment 2.
Figure 14:
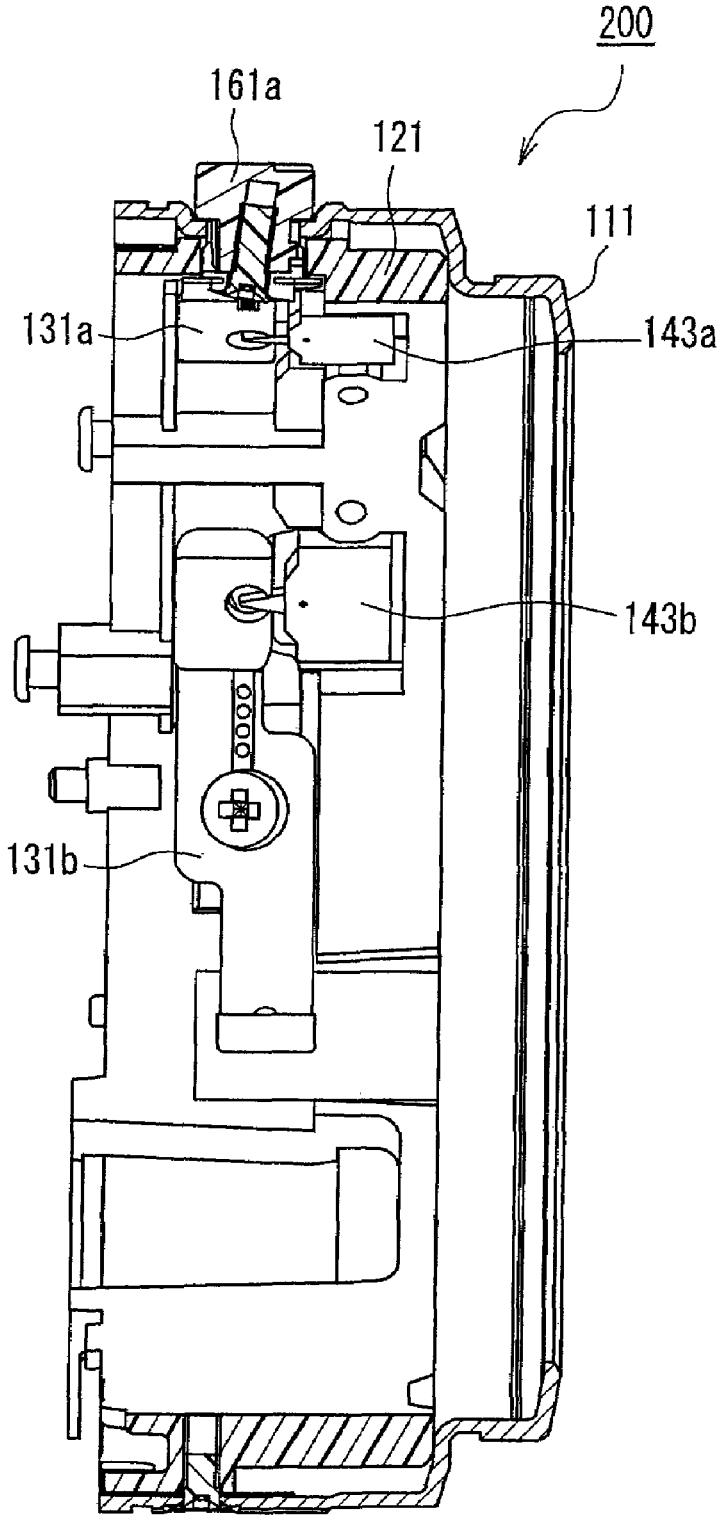
FIG. 14 is a cross-sectional view of the lens unit in Embodiment 2.
Figure 15:
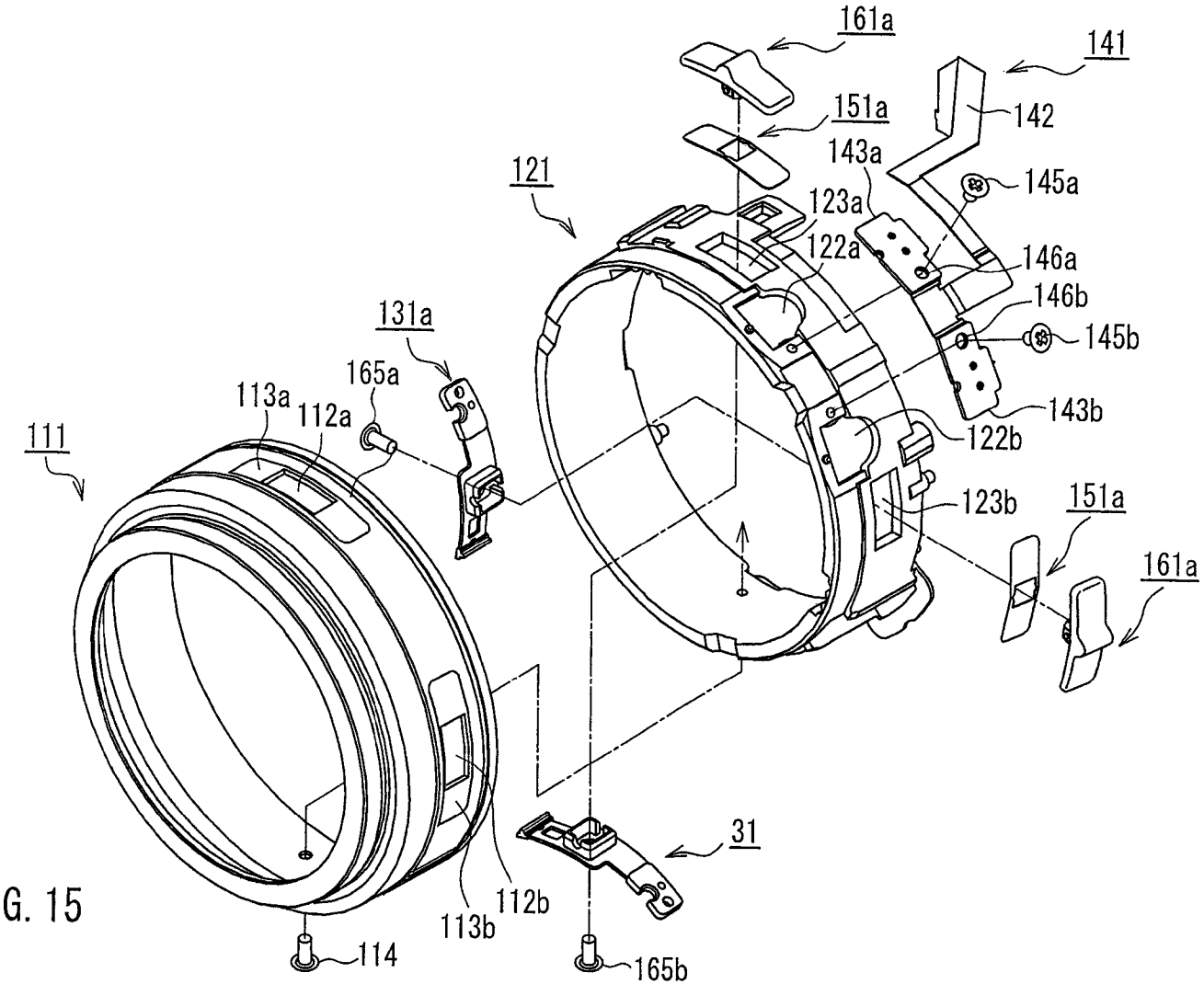
FIG. 15 is an exploded perspective view of a slide switch apparatus in Embodiment 2.
Figure 16:
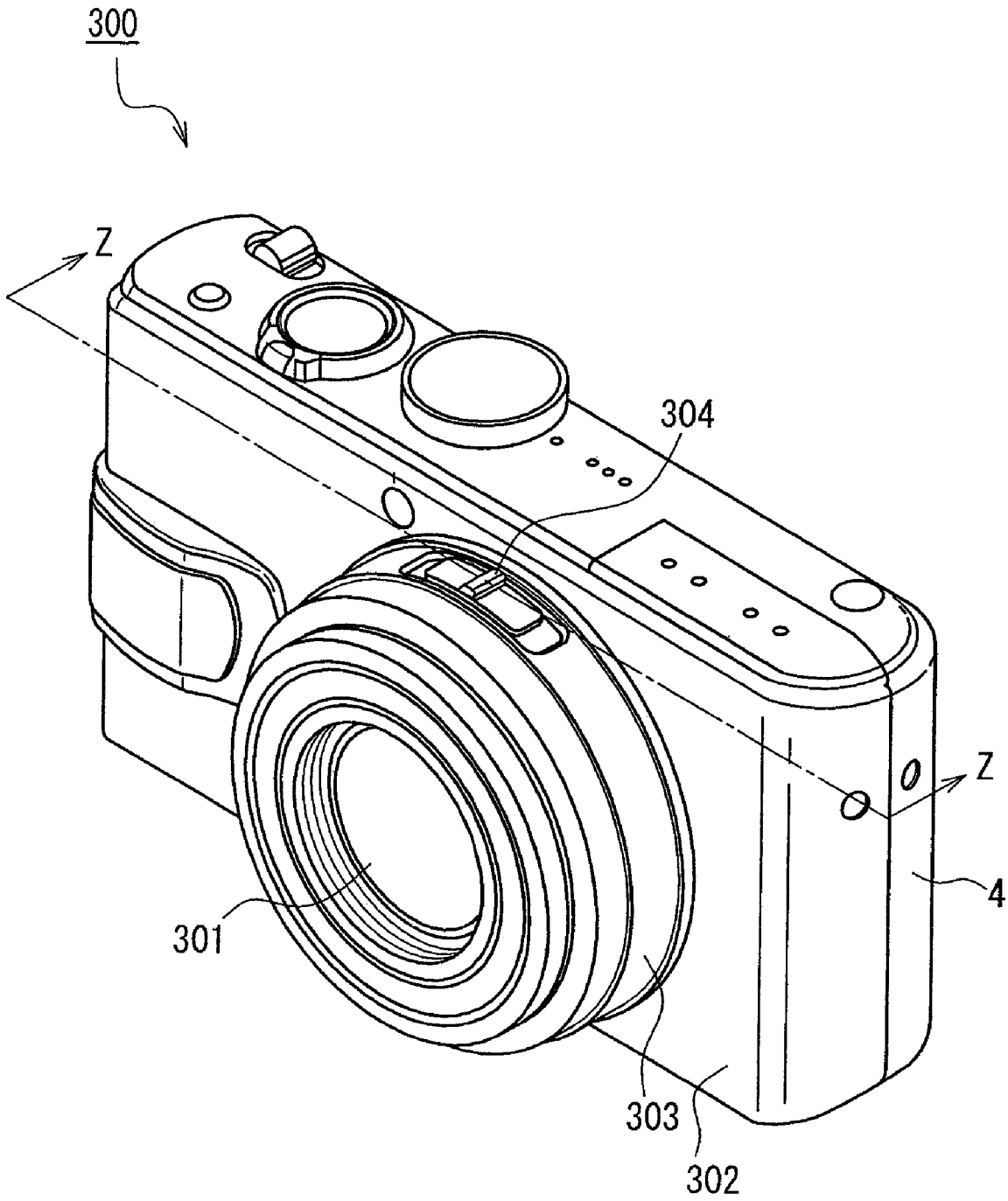
FIG. 16 is a perspective view of a photographing apparatus with a conventional slide switch apparatus mounted thereon.
Figure 17:
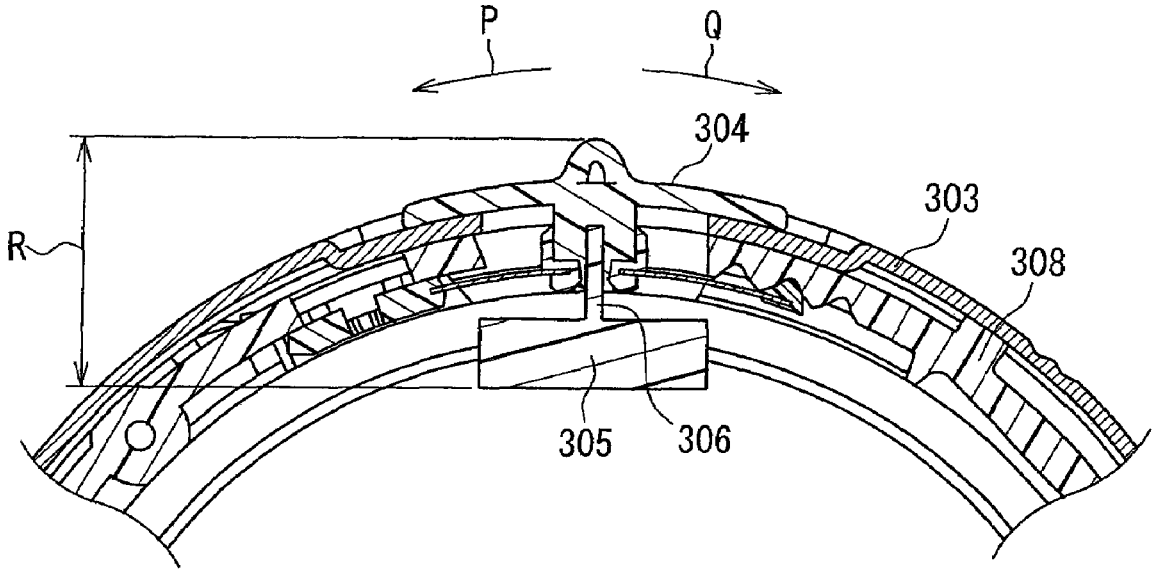
FIG. 17 is a partial cross-sectional view of the conventional slide switch apparatus.

FIG. 13 is a cross-sectional view taken along the line Y-Y in FIG. 1, showing a cross-section of a lens unit in Embodiment 2. FIG. 14 is a cross-sectional view taken along an X-X line in FIG. 1. FIG. 15 is an exploded perspective view of the lens unit in Embodiment 2.

As shown in FIGS. 13 to 15, in the present embodiment, on the outer circumferential cylindrical surface of a lens unit 200, a first slide switch unit 201 and a second slide switch unit 202 are placed with a predetermined gap therebetween. The first slide switch unit 201 mainly includes a click spring 131*a*, a slide switch 143*a*, a slide knob 161*a*, and a screw 165*a*. The second slide switch unit 202 mainly includes a click spring 131*b*, a slide knob 161*b*, a slide switch 143*b*, and a screw 165*b*.

Furthermore, on the cylindrical surface of a lens ring 111, a hole 112*a* and a sliding portion 113*a* are placed so that the first slide switch unit 201 can be placed, and a hole 112*b* and a sliding portion 113*b* are placed so that the second slide switch unit 202 can be placed.

Furthermore, on the cylindrical surface of a lens frame 121, a hole 123*a* is formed so that the first slide switch unit 201 can be placed, and a hole 123*b* is formed so that the second slide switch unit 202 can be placed. Furthermore, on the lens frame 121, a hole 122*a* allowing the slide switch 143*a* to be placed and a hole 122*b* allowing the slide switch 143*b* to be placed are formed. Furthermore, as shown in FIG. 13, on the inner surface of the lens frame 121, a first click groove 124*a*, a second click groove 125*a*, and a third click groove 126*a*, in which the protrusion 132*a* in the first slide switch unit 201 can be fitted selectively, are formed, and a first click groove 124*b*, a second click groove 125*b*, and a third click groove 126*b*, in which the protrusion 132*b* in the second slide switch unit 202 can be fitted selectively, are formed.

Furthermore, the click springs 131*a* and 131*b* have shapes symmetrical to each other. Furthermore, the slide knobs 161*a* and 161*b* are composed of the same member. Furthermore, the sliding sheets 151*a* and 151*b* are composed of the same member.

Each of the above members is the same as that in Embodiment 1, so that the detailed description of each member will be omitted.

At the end of the FPC unit 141, the slide switch 143*a* and the slide switch 143*b* are placed. The slide switches 143*a* and 143*b* are placed so as to be opposed to each other at the end of the FPC 142.

Next, a method for assembling a slide switch apparatus of the present embodiment will be described.

In FIG. 15, first, the FPC unit 141 to which the slide switches 143*a* and 143*b* are connected is placed on the cylindrical surface of the lens frame 121. At this time, the FPC unit 141 is placed so that the slide switch 143*a* is positioned in the hole 122*a*, and the slide switch 143*b* is positioned in the hole 122*b*. The interval between the slide switch 143*a* and the slide switch 143*b* is designed considering the interval between the holes 122*a* and 122*b*. Therefore, the positioning of one slide switch substantially determines the position of the other slide.

Next, a screw 145*a* is inserted through a hole 146*a* to be screwed in a screw hole 128*a*. Furthermore, a screw 145*b* is inserted through a hole 146*b* to be screwed in the screw hole 128*b*. Consequently, the FPC unit 41 can be fixed to the lens frame 121.

In the slide switch apparatus in the present embodiment, two slide switch units are placed. Therefore, although the number of components such as the click spring 31 and the slide knob 61 increases, the assembly procedure is substantially the same as that of the slide switch apparatus in Embodiment 1. Therefore, the subsequent assembly description will be omitted.

In the slide switch apparatus assembled as described above, the slide knob 161*a* and the slide knob 161*b* can slide independently.

As described above, according to the present embodiment, a plurality of slide switches 143*a* and 143*b* are connected to one FPC 142 to form a unit, so that the assembly becomes easy.

Furthermore, the slide switches 143*a* and 143*b* are placed so as to be symmetrical to each other, which shortens the distance between the switches. Therefore, the length of the FPC 142 placed between the switches can be decreased.

In the present embodiment, although two slide switches are formed, three or more switches may be formed.

The slide switch according to the present invention is useful for various appliances, without being limited to a photographing apparatus such as a digital still camera.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A slide switch apparatus, comprising:

a slide member movable along a side surface portion of a housing; and a switch that is placed on the side surface portion of the housing and is capable of switching an operation state when a portion to be acted on is driven, the slide member including:

a switch engagement portion capable of driving the portion to be acted on in accordance with a movement of the slide member along the side surface portion of the housing;

a click portion that comes into contact with the housing or another member, thereby generating a click feeling when moving along the side surface portion of the housing; and a portion to be held, which allows the housing to movably hold the slide member, the slide member and the switch being placed adjacent to each other along the side surface portion of the housing;

the portion to be acted on being capable of being driven in a plane substantially parallel to the side surface portion of the housing.

2. The slide switch apparatus according to claim 1, wherein the switch is placed at a position overlapping the switch engagement portion in a thickness direction.

3. The slide switch apparatus according to claim 2, wherein the slide member includes a concave portion at a site opposed to the switch, and a part or entirety of the switch is placed in the concave portion.

4. The slide switch apparatus according to claim 1, wherein the portion to be acted on is a switch lever, a concave portion in a substantially Ω shape is formed in the switch engagement portion, and the switch lever is engaged with the concave portion.

5. The slide switch apparatus according to claim 4, wherein the switch engagement portion is thicker than the switch lever.

6. The slide switch apparatus according to claim 1, wherein the switch engagement portion is made of resin.

7. The slide switch apparatus according to claim 1, further comprising a slide knob that is placed on a surface of the housing and fixed to the slide member, wherein, on the surface of the housing, a concave portion is formed at a site where the slide knob is placed.

8. The slide switch apparatus according to claim 1, further comprising a slide knob that is placed on a surface of the housing and fixed to the portion to be held of the slide member, wherein, in the slide knob, a rib is formed at a site where the slide knob is fixed to the portion to be held, and in the portion to be held, a concave portion capable of being engaged with the rib is formed.

9. The slide switch apparatus according to claim 1, further comprising a slide knob that is placed on a surface of the housing and fixed to the portion to be held of the slide member with a screw, wherein the screw is placed so as to tilt with respect to a vertical line of a principal plane of the slide member.

10. The slide switch apparatus according to claim 1, further comprising a substrate capable of being deformed elastically, on which the switch engagement portion, the click portion, and the portion to be held are placed, wherein a hole is formed between the click portion and the portion to be held on the substrate.

11. The slide switch apparatus according to claim 1, wherein the switch is composed of a self-reset type switching element.

12. The slide switch apparatus according to claim 1, further comprising a substrate, wherein the click portion, the portion to be held, and the switch engagement portion are formed on the substrate by molding resin at one time.

13. The slide switch apparatus according to claim 1, further comprising a substrate, wherein the switch engagement portion, the click portion, and the portion to be held are formed on the substrate after the substrate is bent.

14. The slide switch apparatus according to claim 1, wherein the housing comprises:

a first housing in which at least the slide member and the switch are placed; and a second housing that covers a surface of the first housing, wherein the switch is connected to a flexible substrate capable of being connected electrically to another circuit, and the fixable substrate is placed between the first housing and the second housing.

15. The slide switch apparatus according to claim 1, comprising a plurality of switches, wherein the plurality of switches are connected to one flexible substrate capable of being electrically connected to another circuit.

16. The slide switch apparatus according to claim 15, comprising a first switch and a second switch as the plurality of switches, and a first slide member and a second slide member for driving the respective switches, wherein the first slide member and the second slide member are attached to the housing so that respective switch engagement portions are placed at a site where the first slide member and the second slide member are opposed to each other.

17. The slide switch apparatus according to claim 1, wherein the portion to be held is placed between the switch engagement portion and the click portion in a movement direction of the slide member.

* * * * *